United States Patent [19]

Waiser

[11] Patent Number: 4,732,134

[45] Date of Patent: Mar. 22, 1988

[54] PROJECTILE SLIDE-PUSHERS FOR CROSS BOWS

[76] Inventor: Shimon Waiser, P.O. Box 360 Midwood Station, Brooklyn, N.Y. 11230

[21] Appl. No.: 834,552

[22] Filed: Feb. 28, 1986

Related U.S. Application Data

[63] Continuation-in-part of Ser. No. 536,545, Sep. 28, 1983, Pat. No. 4,593,675.

[51] Int. Cl.[4] ..... F41B 5/00; F41D 10/00

[52] U.S. Cl. ..... 124/25; 124/41 R; 124/37

[58] Field of Search ..... 124/25, 24 R, 41 R, 124/20 B, 21, 22, 26, 35 R, 37

[56] References Cited

U.S. PATENT DOCUMENTS

| | | | |
|---|---|---|---|
| 47,815 | 5/1865 | Hall | 124/21 |
| 269,249 | 12/1882 | Wilcox | 124/25 |
| 920,565 | 5/1909 | Greenwood | 124/21 |
| 1,375,990 | 4/1921 | Yorgensen | 124/25 |
| 2,092,361 | 9/1937 | Shirn | 124/25 |
| 2,313,803 | 3/1943 | Carlson | 124/25 |
| 2,500,509 | 3/1950 | Bailey | 124/35 R |
| 2,663,291 | 12/1953 | Hall | 124/41 R |
| 3,963,017 | 6/1976 | Pfotenhauer | 124/41 R |
| 4,192,281 | 3/1980 | King | 124/25 |

FOREIGN PATENT DOCUMENTS

| | | | |
|---|---|---|---|
| 518582 | 3/1940 | United Kingdom | 124/41 R |

*Primary Examiner*—Richard C. Pinkham
*Assistant Examiner*—Benjamin Layno

[57] ABSTRACT

Projectile slide-pushers for crossbows. These slide-pushers are made of rigid material and each has a bottom surface conforming to upper outer surface of a crossbow barrel. A common surface on the projectile slide-pusher functions as both a projectile pusher and catch engaging surface. These slide-pushers perform longitudinal motions, parallel to and along the cross bow barrel during shooting.

25 Claims, 15 Drawing Figures

124
137
136
114
135
114c
111
111

110
112
112
132
132
137
24
111d
136
135
114
111

137
24
136
111
114c
114a
131
133
28
111c
135
114
114b
134

PROJECTILE SLIDE-PUSHERS FOR CROSS BOWS

This application is a continuation-in-part of Ser. No. 06/536,545 filed Sept. 28, 1983 and issued on June 10, 1986 as U.S. Pat. No. 4,593,675.

BACKGROUND OF THE INVENTION

This invention relates to cross bows as used by sportsmen and hunters for shooting of arrows (bolts) or pellets, and more specifically to projectile slide-pushers and movable bow fastening devices for such cross bows.

A known cross bow has a rigidly mounted bow on the end of the stock which incorporates a trigger mechanism for releasing a taut bow string so as to shoot a projectile therefrom.

The first considerable disadvantage of the known cross bow lies in the fact that the known cross bows are divided into two groups, namely, arrow shooting cross bows and pellet shooting cross bows, each of which can shoot only one type of projectile - arrows or pellets, but not both types from the same cross bow.

The second disadvantage of the known cross bow lies in the fact that a bow string should be waxed after every several shots, and even after this, its life is very short because of a friction between the string and the barrel.

The third disadvantage of the known cross bow lies in the fact that for good accuracy of the cross bow, the bow string should be at exactly a 90° angle to the barrel, and it should be pulled back evenly for each shot.

The fourth disadvantage of the known cross bow lies in the fact that the known cross bow always has only one bow draw weight because the distance between the bow and the catch of the bow string is the same for each particular cross bow.

The fifth disadvantage of the known cross bow lies in the fact that it is not easy to return the bow string to its initial uncocked position without shooting, if desired, after the cross bow was cocked.

SUMMARY OF THE INVENTION

Accordingly, it is an object of the present invention to provide a cross bow which avoids the disadvantages of the prior art and has variable bow draw weight from zero to the maximum.

Another object of the invention is to provide a cross bow which can be easily converted from shooting of bolts to shooting of pellets, especially lead balls of different sizes.

It is a further object of the present invention to provide a cross bow with a special pellet holder attached to the bow string and having a special recess to contain a pellet.

It is another object of the invention to provide a cross bow with a catch for holding the pellet holder in a cocked position and for closing (at least partially) the pellet recess of said holder to prevent spontaneous falling out of the pellet before a shot.

It is also an object of this invention to provide a cross bow with a special bolt slide-pusher attached to the bow string for pushing a bolt during a shot, that prevents a contact of the string with the barrel and thereby increases very much the life of the string.

Other objects and advantages of the present invention will be apparent from the accompanying description when considered in conjunction with the accompanying drawings.

DETAILED DESCRIPTION

Figure 1:
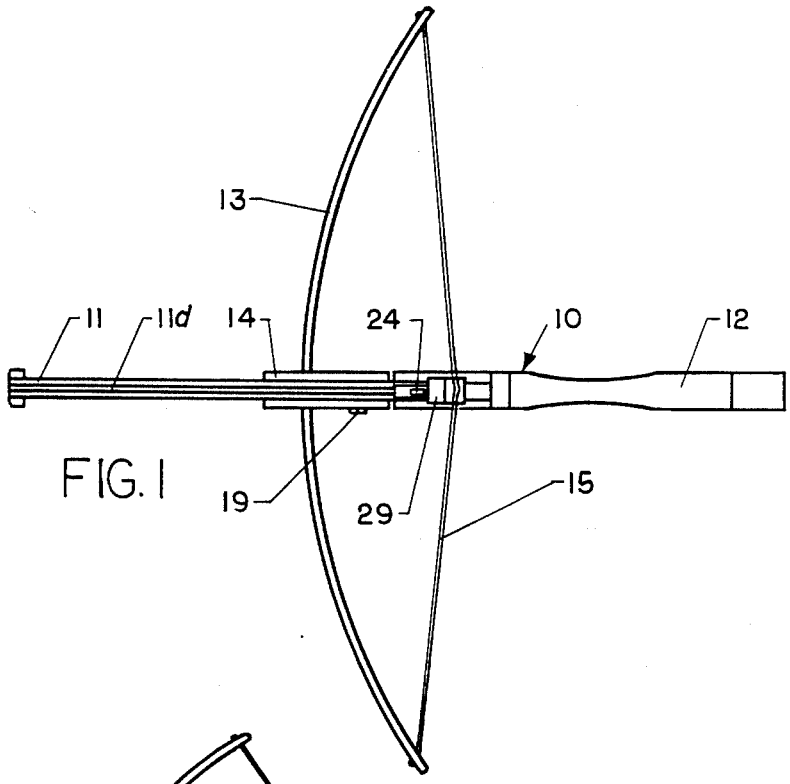
FIG. 1 is a top plan view of the cross bow in an initial precocked position, with the bow slide moved rearwards, and with the pellet holder attached to the string.
Figure 2:
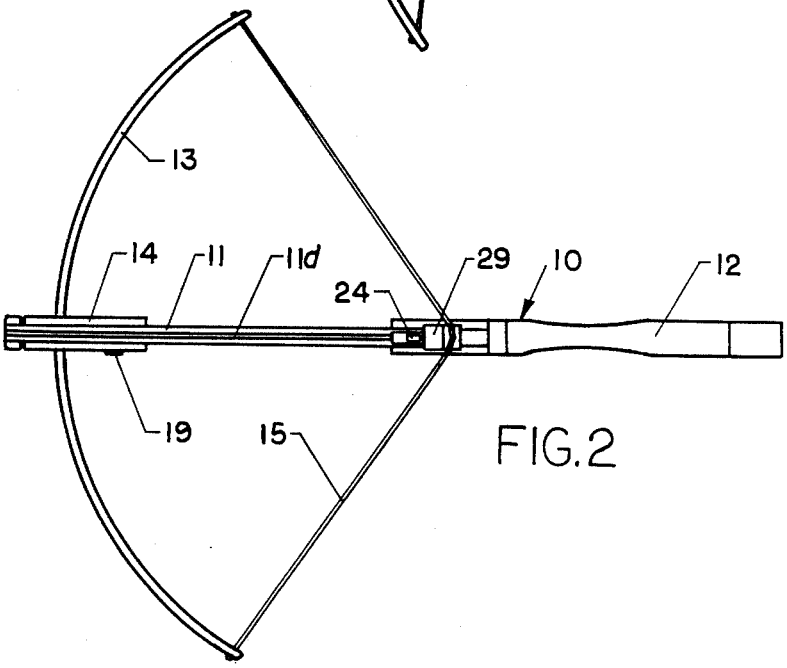
FIG. 2 is a top plan view of the cross bow in a cocked position with the bow slide moved forward, as much as possible, and with the pellet holder attached to the string.
Figure 4:
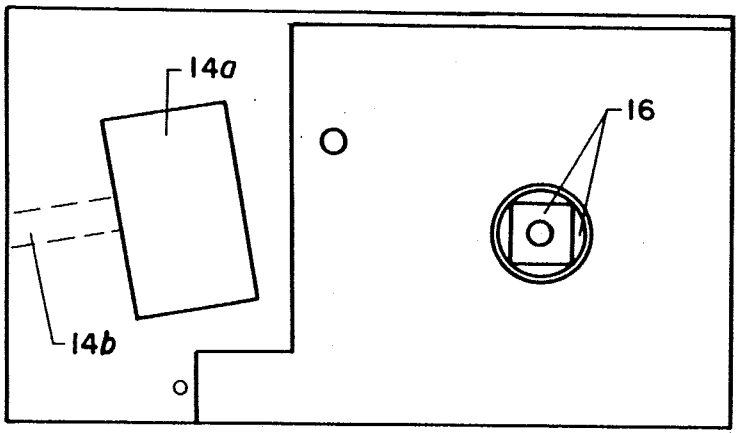
FIG. 4 is an enlarged side view of the left hand side of the bow slide with a ratchet gear wheel, a pawl and a pawl spring removed.

Referring more in detail to the drawings, and first to a cross bow disclosed in FIGS. 1–13, which can shoot bolts and pellets.

The cross bow may be seen to comprise a stock 10 having a fore end portion 11, a butt 12, a bow slide 14 with a bow 13 attached to it and a bow string 15 attached to the corresponding ends of the bow 13.

The fore end portion 11 consists of two parts, namely, an upper part 11*a* and a lower part 11*b* and has a bow slide recess 11*c* in which the bow slide 14 is located. The upper and the lower inside surfaces of the recess 11*c* form the guideways along which the bow slide 14 can perform longitudinal or reciprocating motion relative to the stock when the cross bow is being cocked. The external surface of the upper part 11*a* of the fore end portion 11 has a shape conforming to the shape of a pellet holder 29 and a bolt pusher 31 for guiding of said holder and pusher during their movement. Besides, the upper external surface of the upper part 11*a* of the fore end portion 11 has a guideway 11*d* along which a bolt 32 can be projected by the string or the pusher 31 when they are released from a catch 24.

The bow slide 14 has an aperture 14*a* of rectangular shape corresponding to the cross section of the bow 13, which is fastened to the bow slide 14 by a screw (not shown) located in a threaded hole 14*b*. Besides, on the bow slide 14 is mounted an intermediate element 16 having a square recess 16*a* for connecting with a wrench by which the cross bow can be cocked. On this element 16 is mounted by a dowel 18 a gear wheel 17, the teeth of which engage the teeth of the lower part 11*b* of the fore end portion 11 which is formed as a gear rack. Another ratchet gear wheel 20 is mounted on a square projection of the element 16 and is fastened to this projection by a screw 19. The teeth of the ratchet wheel 20 engage a pawl 21 which is pivotally mounted on the bow slide 14 by a screw 22 and is under the action of a tension spring 23.

The ratchet gear wheel 20, the pawl 21, the screw 22, the spring 23, the gear wheel 17 and the gear rack 11*b* are components of locking means which allow the slide 14 to move in one direction (to left) and do not allow the slide 14 to move in an opposite direction (to right) without disengaging the pawl 21 from the ratchet gear wheel 20.

The gear rack 11*b*, the gear wheel 17 and an additional wrench (not shown), the square projection of which enters into a square recess 16*a* of the element 16, are components of cocking means.

The catch 24 is pivotally mounted in the fore end portion 11 and it is under the action of a tension spring 25. This catch 24 is mainly disposed within a slot which extends from the upper surface to the lower surface of the fore end portion 11. The catch 24 is held in the cocked position by a pivotally mounted trigger 26 which is under the action of a spring 27 and is also mainly disposed within the same slot in the fore end portion 11. A lower portion of the trigger 26 projects from the lower end of the slot so that it is accessible to a user.

In the same slot under the left part of the trigger 26 a safety cam 28*a* and a safety cam fixing spring 29 are mounted, and this safety cam 28*a* is connected to a safety knob 28 which is located on lateral external surface of the fore end portion to be accessible to the user.

As mentioned above, the invented cross bow can fire both bolts and pellets. For shooting of bolts the string 15 can be used in the usual manner without using of the bolt pusher 31. In such a case, the string life will be very short. To prolong string life, the bolt pusher 31 should be used. This bolt pusher 31 should be connected to the string 15 and placed on the flat external surface of the upper part 11*a* of the fore end portion of the stock, which has the shape conforming to the shape of the bolt pusher 31 and the pellet holder 29. The bolt pusher 31 has an opening 31*a* in which the string 15 is disposed. The bolt pusher 31 has also a bolt pushing surface 31*b* and two catch engaging surfaces 31*b* and 31*c*, one of which, namely, surface 31*b* is simultaneously the bolt pushing surface. When the catch engaging surface 31*c* is engaged by the catch 24 (see FIG. 9), the tension of the bow 13 is less than the bow tension when the catch 24 engages the catch engaging surface 31*b* (see FIG. 10), if the bow 13 is located in the same position relative to the stock. But, after the release of the bolt pusher 31 from the position shown in FIG. 9, the movement of the bolt 32 is smoother than after the release of the bolt pusher from the position shown in FIG. 10.

For shooting of pellets the pellet holder 29, which is made of solid and rigid material, is connected to the string 15 and placed on the external surface of the upper part 11*a* of the fore end portion of the stock. This pellet holder 29 has a recess 29*a* to contain a pellet (preferably balls of different sizes). During a shot the rear part of said recess 29*a* performs a function of a guiding surface to guide a ball shaped pellet and to center the pellet in said recess 29*a*. The purpose of using of said guiding surface is to keep the ball shaped pellet immovable relative to said pellet holder 29 during a shot for good accuracy of the cross bow. If the ball shaped pellet is immovable relative to the pellet holder during a shot, then the more uniformly the holder 29 moves on the stock the more accurately and uniformly the trajectory of the ball shaped pellet is during every shot, because the pellet 30 moves on a straight line parallel to the stock. To perform the functions properly the rear guiding surface of a recess 29*a* should be shaped as a cone, sphere or other, serving to center a ball shaped pellet during a shot. In the rear part of the pellet holder 29 there is an opening 29*b* in which the string 15 is disposed. The opening 29*b* can be shaped as a through transversal slot or as a through transversal hole.

The invented cross bow has actually three positions, namely, a precocked position, a cocked position and a postshooting position.

The precocked position (see FIG. 1) is a position in which the slide of the cross bow is located in the very extereme right position closest to the catch and either the bow string or the bolt pusher or the pellet holder is engaged by the catch. In this position the bow tension and springing are minimum.

The cocked position (see FIG. 2) is a position in which the slide of the cross bow is moved to the fore end of the cross bow from the precocked position, with the purpose of bending the bow and strengthening the bow and the bow string tensions. In this cross bow this position is indefinite because the slide of the cross bow can be located in any position from the extreme left position to almost the extreme right position, depending on a desired bow draw weight and a bow tension or springing. The further the slide is moved to the left, the greater bow draw weight, tension and springing are.

The postshooting position is a position in which the slide of the cross bow stays after a shot.

It is obvious that when the cross bow is being cocked from the precocked position the bow slide performs longitudinal motion, and when the cross bow is being cocked from the postshooting position the bow slide performs reciprocating motion.

There is a little difference between pellet shooting and bolt shooting from this cross bow. So if the user wants to fire a pellet, he places the pellet in the recess 29*a* of the holder 29 when the cross bow is in the right position close to the catch 24, but when the holder 29 is not engaged by the catch yet and only after this the user moves the holder 29 to the right to engage the holder 29 with the catch 24. If the user wants to fire a bolt, then he places the bolt on its guideway lld only after the bow string 15 or the bolt pusher 31 is engaged by the catch 24. The rest of manipulation with this cross bow is the same for shooting both bolts and pellets.

OPERATION.

(a) The shooter uses bolts and the bolt pusher is attached to the string.

For cocking the cross bow when it is in the post-shooting position the user first of all disactivates the locking means by turning counter-clockwise the pawl 21 disengaging it from the ratchet gear wheel 20 and holding said pawl 21 in said position. After this the user moves by hand the slide 14 rearwardly until the bolt pusher 31 reaches the catch 24 and pushes the upper part of the catch downwardly and rearwardly rotating it clockwise till the upper part of the catch 24 lowers under the level of the central bottom part of the bolt pusher 31 allowing the latter to pass above.

Figure 9:
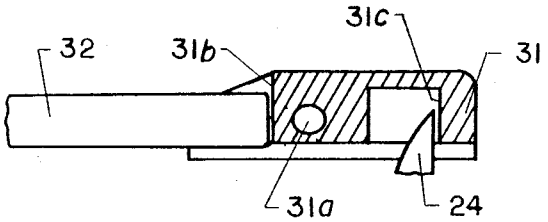
FIG. 9 is an enlarged fragmentary cross-sectional view of a bolt pusher, a bolt, and a catch, showing the parts when the catch engages a rear catch engaging surface of the bolt pusher.

If the bolt pusher 31 is stopped when its engaging surface 31*c* just passed the upper part of the catch 24, then the catch 24 under the action of its spring turns counter-clockwise to its initial position engaging the engaging surface 31*c* of the bolt pusher 31 (see FIG. 9). This is the first engaging position of the bolt pusher 31.

Figure 10:
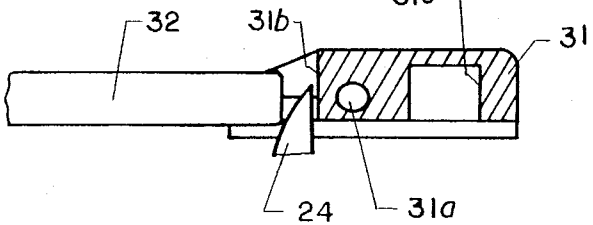
FIG. 10 is a fragmentary cross-sectional view similar to FIG. 9, showing the parts when the catch engages a front catch engaging surface of the bolt pusher, which simultaneously is a bolt pushing surface of the bolt pusher.

If the bolt pusher 31 is stopped when its engaging surface 31*b* just passed the upper part of the catch 24, then the catch 24 under the action of its spring turns counter-clockwise to its initial position engaging the engaging surface 31*b* of the bolt pusher 31 (see FIG. 10). This is the second engaging position of the bolt pusher 31. After this the user releases the pawl 21 activating the locking means again. Now the cross bow is in the precocked position, and for cocking the cross bow when it is in said precocked position it is necessary to move the slide 14 with the bow 13 to the left to a desired cocked position in accordance with a desired bow draw weight which can vary from a few Lbs to the maximum possible bow draw weight. The simplest way to move the slide 14 and the bow 13 to the left is to push the bow 13 by hand or even by foot to the left. If, however, the user is not strong enough to do this, then he can use for this purpose a mechanic's wrench having a square projection for connection of conventional sockets. The user needs to insert the square projection of the wrench into the square recess 16*a* of the element 16 and to turn this element 16 clockwise with the wrench. Then the gear wheel 17 will move forward, because of engagement between it and the gear rack 11*b*, moving the slide 14 with the bow 13 to the desired red cocked position in accordance with the desired bow draw weight, springing or tension.

When the cross bow is cocked and a bolt is placed on its guideway the cross bow is ready to fire.

Figure 3:
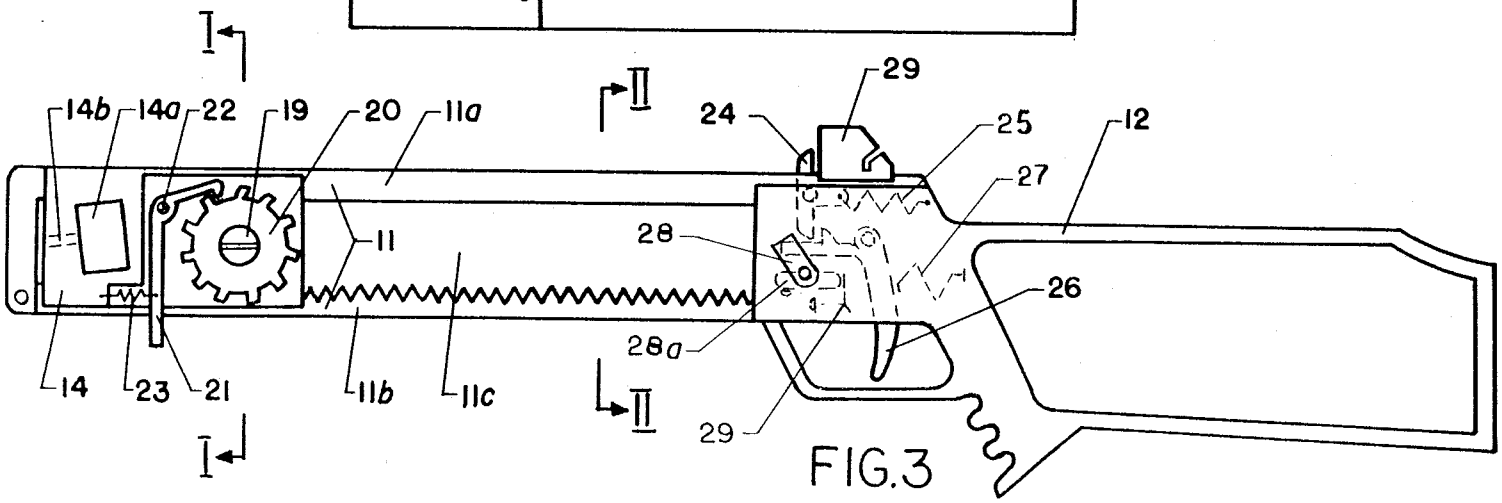
FIG. 3 is an enlarged side elevational view of the cross bow of FIG. 2 with a bow and a string removed.
Figure 6:
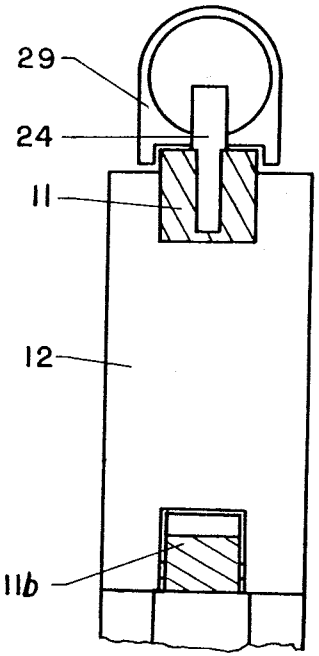
FIG. 6 is an enlarged fragmentary cross-sectional view of the cross bow of FIG. 3 taken along line II—II.
Figure 5:
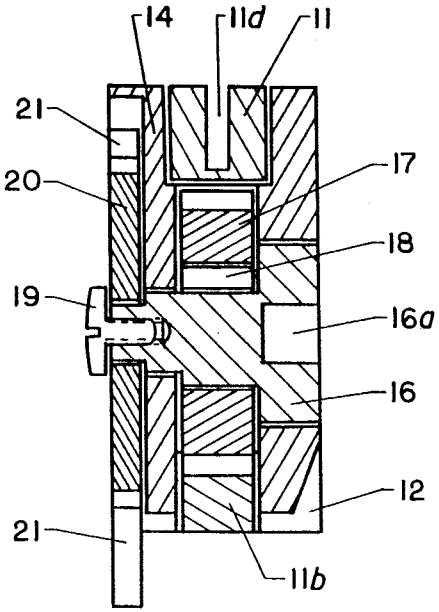
FIG. 5 is an enlarged cross-sectional view of the cross bow of FIG. 3 taken along line I—I.
Figure 7:
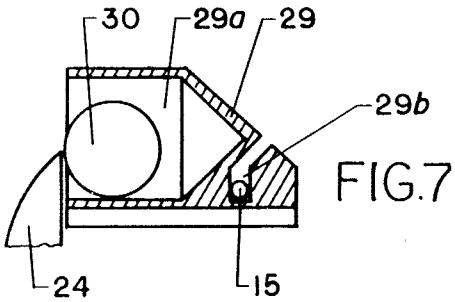
FIG. 7 is an enlarged cross-sectional view of a pellet holder with a lead ball before a shot.
Figure 8:
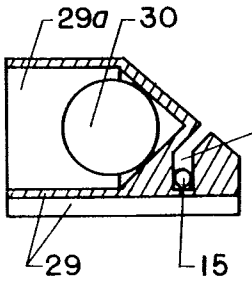
FIG. 8 is an enlarged cross-sectional view of a pellet holder with a lead ball while the holder is moving during a shot.
Figure 11:
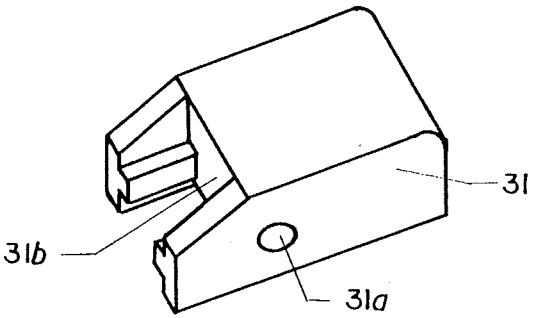
FIG. 11 is a perspective view of the bolt pusher if it is observed from above.
Figure 12:
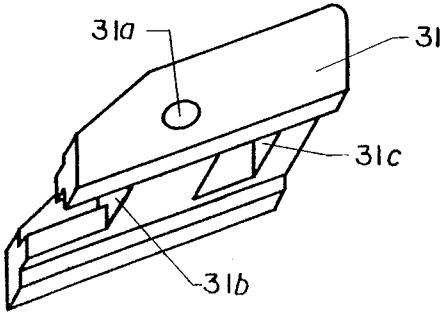
FIG. 12 is another perspective view of the bolt pusher if it is observed from below.

To fire the cross bow the user should position the safety cam 28*a* in a horizontal position in order not to prevent the trigger 26 to be turned counter-clockwise (see FIG. 3). He can make this by turning the safety knob 28 to "OFF" position. After this if the user turns the trigger 26 counter-clockwise he disengages by it the upper part of the trigger 26 from the lower part of the catch 24. The catch 24 under the action of the bow string 15 will turn counter-clockwise releasing the bolt pusher 31, which together with the bolt is propelled forwardly. The catch spring 25 immediately returns the catch 24 to its initial position and when the user releases the trigger 26 the trigger spring 27 also returns the trigger 26 to its initial position. Now the cross bow is in the postshooting position again, and for firing the next bolt the cycle has to be repeated.

(b) The shooter uses bolts but the bolt pusher is not attached to the string.

The operation with the cross bow when the user uses bolts and the bolt pusher 31 is not attached to the string 15 is basically the same as it was described above. The only difference is that the catch 24 engages and releases the string 15 (but not the pusher 31) which pushes a bolt during a shot.

(c) The shooter uses pellets.

For cocking the cross bow when it is in the post-shooting position the user first of all disactivates the locking means by turning counter-clockwise the pawl 21 disengaging it from the ratchet gear wheel 20 and holding the pawl 21 in said position. After this the user moves by hand the slide 14 rearwardly until the rear part of the pellet holder 29 reaches the upper front part of the catch 24. In this position the pawl 21 is released and a pellet 30 is placed in the recess 29*a* of the pellet holder 29, and after this the pellet holder 29 is moved rearwards. During this movement the pellet holder 29 pushes the upper part of the catch 24 rearwardly and downwardly rotating it clockwise till this upper part of the catch 24 lowers under the bottom part of the pellet holder 29 allowing the latter to pass above, and then the catch 24 under the action of its spring turns counter-clockwise to its initial position shutting the recess 29*a* of the pellet holder 29 to prevent spontaneous falling out of the pellet 30 from the recess 29*a*. Besides, the catch 24 does not allow the pellet holder 29 to move forward till the user pulls the trigger. Now the cross bow is in the precocked position, and to cock the cross bow when it is in this precocked position it is necessary to move the slide 14 with the bow 13 to the left to a desired cocked position in accordance with a desired bow draw weight and tension using for this the user's hand, foot or a mechanic's wrench as described above. The firing process for pellet shooting and for bolt shooting is the same and was described above.

If the cross bow is in the cocked position and a user wants to return the cross bow to the precocked position or to decrease a bow draw weight, bow tension or springing, he should move the bow slide 14 rearwards. To do this, the user should move the bow slide 14 forward a short distance (preferably using the cocking means) till he is able to disengage the pawl 21 from the gear wheel 20 to permit the bow slide 14, which is under the action of the bow springing, to move rearwards to the desired position in accordance with the desired bow tension and springing. During this movement the user should use the cocking means as a brake to prevent fast movement of said slide 14 and its hard braking at the end of said movement that can cause damage to the locking means.

Figures 13, 14, 15:
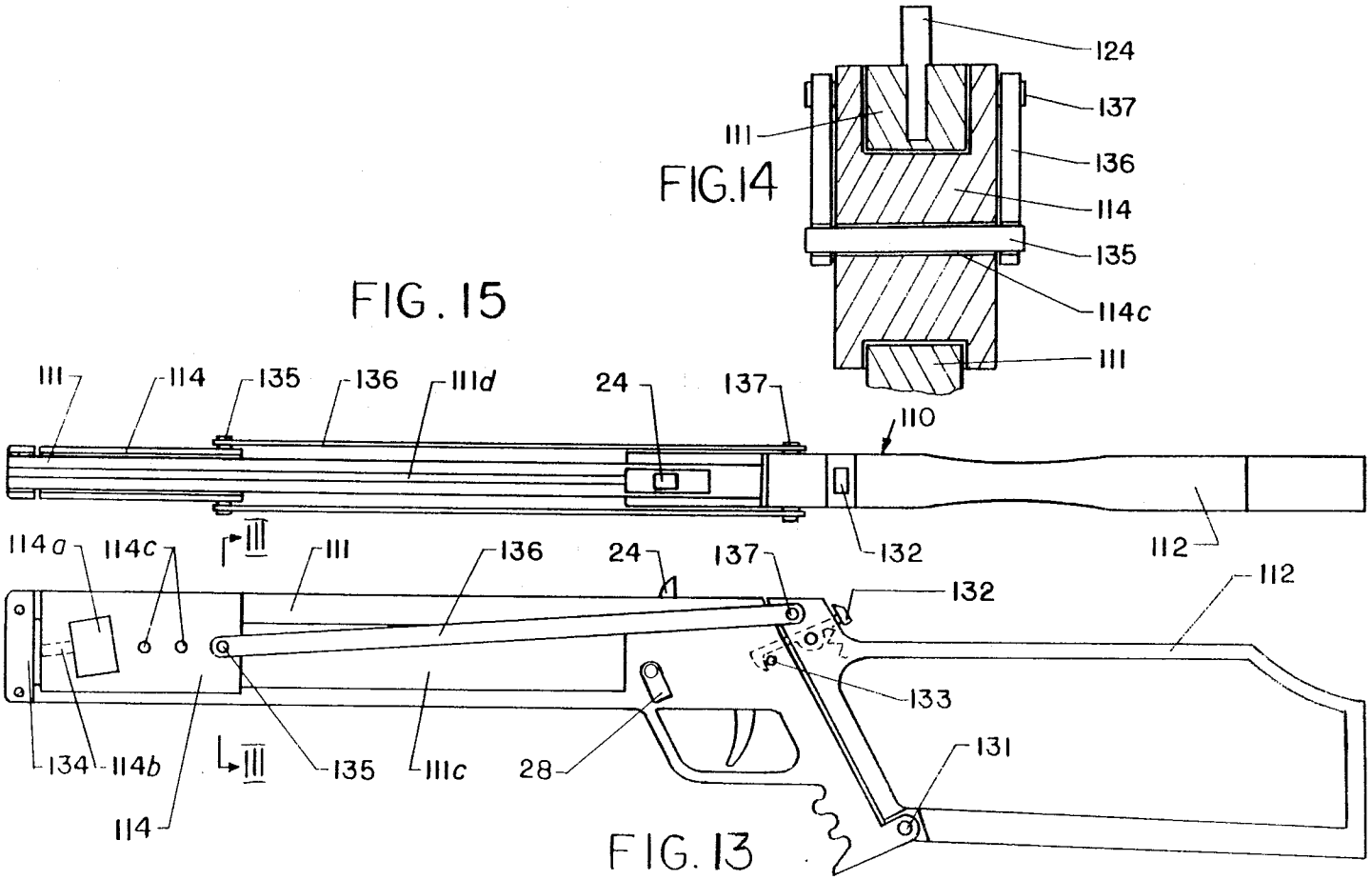
FIG. 13 is a side elevational view of the cross bow of a further modification in a cocked position with the bow and a string removed and with the bow slide moved forward as much as possible.
FIG. 14 is an enlarged fragmentary cross-sectional view of the cross bow of FIG. 13 taken along line III—III.
FIG. 15 is a top plan view of the cross bow of FIG. 13.

Referring now to FIGS. 13, 14 and 15 wherein the general features of the cross bow of the second variation are shown.

The cross may be seen to comprise a stock 110 having a fore end portion 111, a butt 112, a bow slide 114 with a bow (not shown) attached to it and a bow string (not shown) attached to corresponding ends of the bow.

The butt 112 is connected with the fore end portion 111 for pivoting movement relative thereto about a transverse pivot axis by a pivot pin 131.

The butt 112 is pivotally attached a spring-loaded locking lever 132 which is a part of locking means, the second part of which is an axle 133 attached to the rear part of the fore end portion 111. These locking means serve to lock the butt 112 in its working horizontal position when the butt 112 is maximum turned counter-clockwise and its fore end surface is parallel to the rear end surface of the fore end portion 111.

The fore end portion 111 has a slide recess 111*c* in which the bow slide 114 is located. The upper and the lower inside surfaces of the recess 111*c* form the guideway along which the bow slide 114 can perform longitudinal or reciprocating motion relative to the fore end portion 111 when the cross bow is being cocked. The fore end of the fore end portion 111 is shut by a part 134 which fastens together the upper and the lower parts of the fore end portion 111. The external upper surface of the fore end portion 111 has a shape conforming to the shapes of a pellet holder 29 and a bolt pusher 31 for guiding of said holder and pusher during their movements. Besides, the external upper surface of the fore end portion 111 has a guideway 111*d* along which a bolt can be projected by the string or by the bolt pusher 31 when they are released from the catch 24.

The bow slide 114 has an aperture 114*a* of a rectangular shape corresponding to the cross section of the bow (not shown), which is fastened to the bow slide 114 by a screw (not shown) located in a threaded hole 114*b*. Besides, the bow slide 114 has three through holes 114*c* in each of which can be located a pivot pin 135 connecting fore end parts of two cocking members 136 to the bow slide 114. The rear parts of these cocking members 136 are connected to the butt 112 by a pivot pin 137. Both these cocking members 136 have the same elongated form and are arranged parallel to one another on opposite sides of the fore end portion 111.

In the rear part of the fore end portion 111 there is a slot which extends from the upper surface to the lower surface of the fore end portion 111. In this slot there are a catch 24, trigger means and safety means which perform the same functions as in the cross bow of FIGS. 1–12 described above.

Just as the cross bow in FIGS. 1–12, the cross bow in FIGS. 13–15 can fire bolts and pellets using the string 15, the bolt pusher 31 or the pellet holder 29.

The cross bow of the second variation also has three positions, namely, a postshooting position, a precocked position and a cocked position.

The postshooting position is a position in which the slide of the cross bow stays after a shot.

The precocked position is a position in which the bow slide is located in the very extereme right position closest to the catch and either the bow string or the bolt pusher or the pellet holder is engaged by the catch. In this position the butt 112 is inflected downwards relative to the fore end portion 111.

The cocked position is a position in which the bow slide is moved to the fore end of the fore end portion of the cross bow from the precocked position and the cross bow butt 112 is locked in its working horizontal position by the locking lever 132. For this cross bow, there are three cocked positions depending onto which of three holes 114*c* the cocking members 136 are attached. The further the bow slide is moved to the left, the bigger the bow draw weight, the bow tension and springing are. So, for the cross bow of FIG. 13 they are maximum. If the cocking members 136 are attached to the very left hole 114c then the bow draw weight, the bow tension and springing are minimum.

There is a little difference between pellet shooting and bolt shooting from this cross bow and this difference is the same as for the cross bow of the first modification described above.

OPERATION.

(a) The shooter uses bolts and the bolt pusher is attached to the string.

For cocking the cross bow when it is in the postshooting position the user first of all presses the projecting right part of the locking lever 132 downwards turning the locking lever 132 clockwise and disengaging it from the axle 133. Then, by pivoting the butt 112 about the pivot pin 131, the cocking members 136 together with the bow slide 114, and the bow with the string and the bolt pusher 31, can be moved rearwardly. When the bolt pusher 31, which is attached to the string 15, reaches the catch 24, it pushes the upper part of the catch 24 rearwards and clockwise till the upper part of the catch 24 lowers under the level of the central bottom part of the bolt pusher 31 allowing the latter to pass above.

If the bolt pusher 31 is stopped when its engaging surface 31*c* just passed the upper part of the catch 24, then the catch 24 under the action of its spring turns counter-clockwise to its initial position engaging the engaging surface 31*c* of the bolt pusher 31 (see FIG. 9). This is the first engaging position of the bolt pusher 31.

If the bolt pusher 31 is stopped when its engaging surface 31*b* just passed the upper part of the catch 24, then the catch 24 under the action of its spring turns counter-clockwise to its initial position engaging the engaging surface 31*b* of the bolt pusher 31 (see FIG. 10). This is the second engaging position of the bolt pusher 31.

After the catch 24 engages any of said engaging surfaces 31*b* or 31*c* of the bolt pusher 31, the cross bow is in the precocked position. To cock the cross bow, the user turns the butt 112 counter-clockwise moving the bow slide 114 with the bow on it forward. When the butt 112 reaches its working position and the locking lever 132 engages the axle 133 the cross bow is in the cocked position. Now the user places a bolt on its guideway 111*d* and after this the cross bow is ready to fire. The firing process for this cross bow is the same as for the cross bow of the first modification described above.

(b) The shooter uses bolts but the bolt pusher is not attached to the string.

The operation with the cross bow when the user uses bolts and the bolt pusher 31 is not attached to the string is basically the same as it was described above. The only difference is that the catch 24 engages and releases the string (but not the pusher 31) which pushes a bolt during a shot.

(c) The shooter uses pellets and the pellet holder is attached to the string.

For cocking the cross bow when it is in the postshooting position the user first of all presses the projecting right part of the locking lever 132 downwards turning the locking lever 132 clockwise and disengaging it from the axle 133. Then, by pivoting the butt 112 about the pivot pin 131, the cocking members 136 together with the bow slide 114, and the bow with the string and the pellet holder 29, can be moved rearwardly. When the pellet holder 29 reaches the catch 24, the pellet holder 29 pushes the upper part of the catch 24 rearwards and clockwise till said upper part of the catch 24 lowers under the pellet holder 29 allowing the latter to pass above and then the catch 24 under the action of its spring turns counterclockwise to its initial position, shutting (at least partially) the recess 29*a* of the pellet holder 29 to prevent spontaneous falling out of a pellet from the recess 29a. It is obvious that a pellet has to be placed in the recess 29a before said recess is shut by the catch 24. Besides, the catch 24 does not allow the pellet holder 29 to move forward till the user pulls the trigger.

Now the cross bow is in the precocked position and to cock it the user turns the butt 112 counter-clockwise thereby moving the bow slide 114 with the bow on it forward and bending the bow. When the butt 112 reaches its working position and the locking lever 132 engages the axle 133, the cross bow is in the cocked position and is ready to fire. The firing process for this cross bow is the same as for the cross bow of the first modification described above.

Many types of cocking and locking means can be used with the invented cross bows, but one of them has to be mentioned particularly. This is a hydraulic cocking and locking means which has the very same components as a hydraulic car jack (i.e. a hydraulic cylinder, a hydraulic valve, a pumping lever and a ram), but these components will have much smaller dimensions because a car weight is many times greater than a bow draw weight.

It is also obvious that the bow can be made as one-piece construction or can include two halves each of which is attachable to the bow slide.

Although but a few variations of the present invention have been illustrated and described, it will be apparent to those skilled in the art that various changes and modifications may be made therein without departing from the spirit of the invention or from the scope of the appended claims.

What is claimed is:

1. In a cross bow comprising a stock, a bow, a bow string, a pellet holder containing and pushing a pellet during a shot, a releasable catch means for holding the pellet holder in a cocked position, said pellet holder having a front and a catch engaging surface in said front to be engaged by said catch means, the improvement including:

(a) said stock having a longitudinally extended guide surface on which said pellet holder slides, said longitudinally extended guide surface conforming to the shape of said pellet holder for guiding of said holder during its movement;

(b) said pellet holder being made of rigid material, said pellet holder having an original shape and keeping said original shape during shooting, loading and during inactivity, said pellet holder being arranged so as to constantly contact said longitudinally extended guide surface of the stock and having connecting means for connecting with said bow string, said pellet holder having a forward facing part and a pellet recess in said forward facing part for containing inside of said recess pellets of different sizes when the cross bow is cocked and during shooting;

(c) said catch means engaging said catch engaging surface of said pellet holder and simultaneously at least partially closing said recess of said pellet holder to prevent spontaneous falling out of a pellet from said recess and retaining the pellet inside of said recess before a shot when the cross bow is cocked.

2. A cross bow as claimed in claim 1 further comprising a pivot pin, said catch means being pivotally mounted by said pivot pin and said catch means engaging said pellet holder when said pellet holder is in the cocked position.

3. A cross bow as claimed in claim 1, wherein said pellet holder has a bottom outer surface, said longitudinally extended guide surface, on which said pellet holder slides, being an external upper surface of said stock, said longitudinally extended guide surface conforming to a shape of said bottom outer surface of said pellet holder for guiding of said holder during its movement on said external upper surface of the stock.

4. A cross bow as claimed in claim 3 in which said catch means is formed and attached to said stock so as to sink under said external upper surface of said stock when said pellet holder passes above said catch means during a shot.

5. A cross bow as claimed in claim 3 in which said bow string connecting means of said pellet holder is formed as a through transversal opening through which the string passes, said through transversal opening being located above said external upper surface of said stock when said pellet holder is moving on said external upper surface of said stock.

6. The cross bow as claimed in claim 3 wherein said bow string is located so that it presses said external bottom surface of said pellet holder to said external upper surface of said stock during a shot and in the cocked position.

7. A cross bow as claimed in claim 3 wherein a width of said pellet holder is larger than a width of said guiding surface of the stock.

8. A cross bow as claimed in claim 3 and arranged to fire also bolts so that the cross bow is arranged to fire alternatingly pellets and bolts wherein said cross bow has said external upper surface of said stock which has a shape guiding a bolt during its movement on said external upper surface.

9. A cross bow as claimed in claim 8 wherein said external upper surface of the stock has a longitudinally extended deep groove which guides a bolt with vanes during its movement on said external upper surface and which permits at least one bolt vane to move inside of said groove during a shot.

10. A cross bow as claimed in claim 8 further comprising a bolt pusher for bolt shooting and arranged to replace said pellet holder, said bolt pusher being arranged to push the bolt during a shot and having a bottom surface conforming to said longitudinally extended guide surface of said external upper surface of the stock so that said longitudinally extended guide surface can guide alternatingly said pellet holder and said bolt pusher, said bolt pusher being arranged to be held in a cocked position by said catch means.

11. A cross bow as claimed in claim 1 wherein said catch means is a one piece integral part.

12. A cross bow as claimed in claim 1 wherein said catch means has a holder engaging surface which engages said catch engaging surface of said pellet holder and simultaneously prevents a pellet from falling out from said pellet holder so that the same single holder engaging surface of the catch engages the catch means engaging surface of the holder and at least partially closes said recess of said pellet holder so as to retain the pellet inside of said recess behind said catch engaging surface of said pellet holder when the cross bow is cocked.

13. In a cross bow comprising a stock, a bow, a bow string, a bolt pusher for pushing a bolt during a shot, a releasable catch for holding the bolt pusher in a cocked position, said stock having a longitudinally extended guide surface conforming to the shape of said bolt pusher for guiding of said pusher during its movement, said bolt pusher having its outer surface conforming to the shape of said longitudinally extended guide surface of the stock, said bolt pusher having connecting means for connecting with said bow string, said bolt pusher having a bolt pushing surface that propels a bolt during a shot, said bolt pusher having a forward facing part and a catch engaging surface in said forward facing part, the improvement including said bolt pusher in which said catch engaging surface and said bolt pushing surface are combined in one catch engaging and bolt pushing common surface wherein the point on the common surface which engages the catch and the point on the common surface which pushes the bolt is the same point on the common surface, such that said bolt pusher performs simultaneously the functions of both said catch engaging and bolt pushing.

14. A cross bow as claimed in claim 13 in which said bolt pusher has an additional catch engaging surface which is located behind said catch engaging and bolt pushing common surface.

15. A cross bow as claimed in claim 13 in which said bow string connecting means of said bolt pusher is formed as a through transversal opening through which the string passes.

16. A cross bow as claimed in claim 13 further comprising a pivot pin, said catch being pivotally mounted by said pivot pin.

17. In a cross bow comprising a stock, a bow, a bow string, a bolt pusher for pushing a bolt during a shot, a releasable catch for holding the bolt pusher in a cocked position, said stock having a longitudinally extended guide surface conforming to the shape of said bolt pusher for guiding of said pusher during its movement, said bolt pusher having its outer surface conforming to the shape of said longitudinally extended guide surface of the stock, said bolt pusher having connecting means for connecting with said bow string, said bolt pusher having a bolt pushing surface that propels a bolt during a shot, said bolt pusher having a forward facing part and a catch engaging surface in said forward facing part, said forward facing part of the bolt pusher having a through opening exposed from an upper to a bottom surface of said bolt pusher to contain a rear part of a bolt during a shot, the improvement including said bolt pusher in which said catch engaging surface and said bolt pushing surface combined in one catch engaging and bolt pushing common surface that performs simultaneously the functions of both said catch engaging and bolt pushing surface, said through opening having in its rear part said catch engaging and bolt pushing common surface.

18. In a cross bow for shooting pellets and bolts said cross bow comprising a stock having an external upper surface, said external upper surface of said stock (has) having a shape guiding a bolt during its movement on said external upper surface means for pushing a bolt along the upper surface, a bow, a bow string, a pellet holder containing and pushing a pellet during a shot, said pellet holder having an external bottom surface, holding and releasing means for holding said pellet holder in a cocked position and for releasing said pellet holder from the cocked position, said external upper surface of said stock having a longitudinally extended guide surface conforming to the shape of said external bottom surface of said pellet holder for guiding said holder during its movement on said external upper surface of the stock, /the improvement including said pellet holder being made of rigid material and having connecting means for connecting with said bow string, said pellet holder having an original shape and keeping said original shape during shooting, loading and during inactivity, said pellet holder having a forward facing part and a pellet recess in said forward facing part for containing pellets of different sizes during shooting, said recess having a rear part with a centering surface which centres a ball shaped pellet during a shot, said centering surface pushing said pellet on a line parallel to said longitudinally extended guide surface of the stock during a shot.

19. A cross bow as claimed in claim 18 wherein said external upper surface of said stock has a longitudinally extended deep groove which guides a bolt with vanes during its movement on said external upper surface and which permits at least one bolt vane to move inside of said groove during a shot.

20. A cross bow as claimed in claim 18 further comprising a bolt pusher for bolt shooting and arranged to replace said pellet holder, said bolt pusher being arranged to push the bolt during a shot and having a bottom surface conforming to said longitudinally extended guide surface of said external upper surface of the stock so that said longitudinally extended guide surface can guide alternatingly said pellet holder and said bolt pusher, said bolt pusher being arranged to be held in a cocked position and released from said cocked position by said holding and releasing means.

21. In a cross bow comprising a stock having an external upper surface, a bow, a bow string, a bolt pusher for pushing a bolt during a shot, a releasable catch for holding the bolt pusher in a cocked position, said external upper surface of the stock having a longitudinally extended guide surface conforming to the shape of said bolt pusher for guiding of said bolt pusher during its movement, said external upper surface of said stock having a longitudinally extended deep groove which guides a bolt with vanes during its movement on said external upper surface and which permits at least one bolt vane to move inside of said groove during a shot, said bolt pusher having its outer surface conforming to the shape of said longitudinally extended guide surface, said bolt pusher having connecting means for connecting with said bow string, said bolt pusher having a bolt pushing surface that propels a bolt during a shot, said bolt pusher having a forward facing part and a catch engaging surface in said forward facing part, the improvement including sid bolt pusher in which said catch engaging surface and said bolt pushing surface are combined in one catch engaging and bolt pushing common surface that performs simultaneously the functions of both said catch engaging and bolt pushing .

22. In a cross bow comprising a stock, a bow, a bow string, a bolt pusher for pushing a bolt during a shot, a releasable catch for holding the bolt pusher in a cocked position, said stock having a longitudinally extended guide surface conforming to the shape of said bolt pusher for guiding of said pusher during its movement, said bolt pusher having its outer surface conforming to the shape of said longitudinally extended guide surface of the stock, said bolt pusher having connecting means for connecting with said bow string, said bolt pusher having a bolt pushing surface that propels a bolt during a shot, said bolt pusher having a forward facing part and a catch engaging surface in said forward facing part, the improvement including said bolt pusher in which said catch engaging surface and said bolt pushing surface are combined in one catch engaging and bolt pushing common surface that performs simultaneously the functions of both said catch engaging and bolt pushing surface, said catch arranged so that it is located between a tail end of the bolt and said catch engaging and bolt pushing common surface of said bolt pusher when the cross bow is in a cocked position and loaded.

23. In a cross bow comprising a stock having an external upper surface, a bow, a bow string, a pellet holder containing and pushing a pellet during a shot, said pellet holder having an external bottom surface, holding and releasing means for holding said pellet holder in a cocked position and for releasing said pellet holder from the cocked position, said external upper surface of said stock having a longitudinally extended guide surface conforming to the shape of said external bottom surface of said pellet holder for guiding of said holder during its movement on said external upper surface of the stock, the improvement including said pellet holder being made of rigid material as a one piece integral part and having connecting means for connecting with said bow string, said pellet holder having an original shape and keeping sid original shape during shooting, loading and during inactivity, said pellet holder having a forward facing part and a pellet recess in said forward facing part for containing pellets of different sizes during shooting, said recess having a rear part with a centering surface which centres a ball shaped pellet during a shot, said centering surface pushing said pellet on a line parallel to said longitudinally extended guide surface of the stock during a shot.

24. In a cross bow comprising a stock having an external upper surface, a bow, a bow string, a pellet holder containing and pushing a pellet during a shot, said pellet holder having an external bottom surface, holding and releasing means for holding said pellet holder in a cocked position and for releasing said pellet holder from the cocked position, said external upper surface of said stock having a longitudinally extended guide surface conforming to the shape of said external bottom surface of said pellet holder for guiding of said holder during its movement on said external upper surface of the stock, the improvement including said pellet holder being made of rigid material and having connecting means for connecting with said bow string, said pellet holder having an original shape and keeping said original shape during shooting, loading and during inactivity, said pellet holder having a forward facing part and a pellet recess in said forward facing part for containing pellets of different sizes during shooting, said pellet holder having a front and a forward facing outer surface of said front, said pellet recess of said holder having an outlet in said forward facing outer surface of the front for a pellet insertion into said pellet recess and a pellet discharging from said pellet recess, said pellet recess having a rear part with a centering surface which centres a ball shaped pellet during a shot, said centering surface pushing said pellet on a line parallel to said longitudinally extended guide surface of the stock during a shot.

25. In a cross bow comprising a stock, a bow, a bow string, a bolt pusher for pushing a bolt during a shot, a releasable catch for holding the bolt pusher in a cocked position, said stock having a longitudinally extended guide surface conforming to the shape of said bolt pusher for guiding of said pusher during its movement, said bolt pusher having its outer surface conforming to the shape of said longitudinally extended guide surface of the stock, said bolt pusher having connecting means for connecting with said bow string, said bolt pusher having a bolt pushing surface that propels a bolt during a shot, said bolt pusher having a forward facing part and a catch engaging surface in said forward facing part, the improvement including said bolt pusher in which said catch engaging surface and said bolt pushing surface are combined in one catch engaging and bolt pushing common surface which performs simultaneously the functions of both said catch engaging and bolt pushing and which is entirely located above said longitudinally extended guide surface of the stock during a shot and when the cross bow is cocked.

* * * * *

UNITED STATES PATENT AND TRADEMARK OFFICE

CERTIFICATE OF CORRECTION

PATENT NO. : 4,732,134

DATED : March 22, 1988

INVENTOR(S) : Shimon Waiser

It is certified that error appears in the above-identified patent and that said Letters Patent is hereby corrected as shown below:

Column 2, line 51, "13" should read --12--.
Column 5, line 48, delete "red".
Column 6, line 64, The" should read --To the--.
Column 11, line 47, after "surface" insert --are--.
Column 11, line 53, after "bolts" insert --and arranged so that the cross bow fires alternatingly pellets and bolts,--.
Column 11, line 55, delete "(has)".
Column 11, line 57, between "surface" and "means" insert a comma--,--.
Column 11, line 68, delete "/".
Column 12, line 49, "sid" should read --said--.
Column 13, line 23, "sid" should read --said--.

Signed and Sealed this

Eighteenth Day of April, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,732,134

DATED : March 22, 1988

INVENTOR(S) : Shimon Waiser

It is certified that error appears in the above-identified patent and that said Letters Patent is hereby corrected as shown below:

Column 10, line 58, insert --means-- between "catch" and "engages" and delete "means" after second occurrence of "catch"

Signed and Sealed this

Eighth Day of August, 1989

*Attest:*

DONALD J. QUIGG

*Attesting Officer*

*Commissioner of Patents and Trademarks*